US010153564B1

(12) United States Patent
Wu

(10) Patent No.: US 10,153,564 B1
(45) Date of Patent: Dec. 11, 2018

(54) TERMINAL BLOCK FASTENING DEVICE HAVING LOCKING HANDLE

(71) Applicants: DINKLE ENTERPRISE CO., LTD., New Taipei (TW); DINKLE ELECTRIC MACHINERY (CHINA) CO., LTD., Kunshan, Jiangsu (CN)

(72) Inventor: Shang-Tsai Wu, New Taipei (TW)

(73) Assignees: DINKLE ENTERPRISE CO., LTD., New Taipei (TW); DINKLE ELECTRIC MACHINERY (CHINA) CO., LTD., Kunshan, Jiangsu (CN)

( * ) Notice: Subject to any disclaimer, the term of this patent is extended or adjusted under 35 U.S.C. 154(b) by 1 day.

(21) Appl. No.: 15/716,497

(22) Filed: Sep. 26, 2017

(51) Int. Cl.

| | |
|---|---|
| ***H01R 13/62*** | (2006.01) |
| ***H01R 12/00*** | (2006.01) |
| ***H01R 9/26*** | (2006.01) |
| ***H01R 9/24*** | (2006.01) |
| ***H01R 13/629*** | (2006.01) |

(52) U.S. Cl.
CPC ..... *H01R 9/093* (2013.01); *H01R 9/24* (2013.01); *H01R 9/26* (2013.01); *H01R 13/62933* (2013.01)

(58) Field of Classification Search
CPC . H01R 9/093; H01R 9/24; H01R 9/26; H01R 12/72; H01R 12/721; H01R 13/213; H01R 13/62; H01R 13/62933; H01R 23/70
USPC ..... 439/59, 157, 325, 328, 358
See application file for complete search history.

(56) References Cited

U.S. PATENT DOCUMENTS

| | | | | |
|---|---|---|---|---|
| 3,970,353 A * | 7/1976 | Kaufman | ..... | E21C 35/08 439/325 |
| 4,233,646 A * | 11/1980 | Leung | ..... | H05K 7/1409 211/41.17 |
| 4,648,009 A * | 3/1987 | Beun | ..... | H05K 7/1409 211/41.17 |
| 4,975,073 A * | 12/1990 | Weisman | ..... | H05K 7/1409 439/153 |

(Continued)

FOREIGN PATENT DOCUMENTS

| | | |
|---|---|---|
| KR | 20140011942 A | 1/2014 |
| WO | 2017039543 A1 | 3/2017 |

OTHER PUBLICATIONS

Search Report dated Nov. 14, 2017 of the corresponding European patent application No. 17194278.2.

*Primary Examiner* — Chandrika Prasad
(74) *Attorney, Agent, or Firm* — Chun-Ming Shih; HDLS IPR Services

(57) ABSTRACT

A terminal block fastening device (100) includes a body (110) and a locking handle (200). The body (110) includes a socket (124) for insertion of a printed circuit board (10) and two through holes (128) perpendicular to the socket (124). The locking handle (200) is installed in the body (110). The locking handle (200) has a force arm (230), a fastening portion (202) connected to one end of the force arm (230), a pivot point (220) connected to the other end of the force arm (230), and a resilient arm (210) disposed between the fastening portion (202) and the force arm (230). The fastening portion (202) is operatively associated with the resilient arm (210) to move between a locked state (L) and a released state (R), so that the anti-pull-out effect on the printed circuit board (10) is improved.

15 Claims, 8 Drawing Sheets

(56) References Cited

U.S. PATENT DOCUMENTS

| | | | | |
|---|---|---|---|---|
| 4,999,744 | A * | 3/1991 | Blankenship | H05K 7/1409 211/41.17 |
| 6,056,567 | A * | 5/2000 | Schell | H01R 12/7005 439/160 |
| 6,494,729 | B1 * | 12/2002 | Stathopoulos | H01R 13/701 439/160 |
| 6,881,089 | B1 * | 4/2005 | Yang | H01R 12/7058 361/801 |
| 6,992,900 | B1 * | 1/2006 | Suzue | H05K 7/1409 361/726 |
| 7,618,270 | B2 * | 11/2009 | Scherer | H01R 12/7005 439/152 |
| 7,892,015 | B2 * | 2/2011 | Li | H01R 13/6275 439/358 |
| 8,292,642 | B1 * | 10/2012 | Lee | G06K 7/0026 439/159 |
| 8,834,190 | B2 * | 9/2014 | Ngo | H01R 12/7023 439/328 |
| 2013/0040483 | A1 | 2/2013 | Ngo et al. | |

* cited by examiner

TERMINAL BLOCK FASTENING DEVICE HAVING LOCKING HANDLE

TECHNICAL FIELD

The present invention relates to a terminal block fastening device and, in particular, to a terminal block fastening device (i.e. a board to wire type terminal block) coupled to a circuit board and a cable.

BACKGROUND

A terminal block is a common connection assembly extensively used in diverse configurations for industrial communication, electric power industries for reliable and safe power supply, compact and integrated equipment, automatic industrial control, and etc. The terminal block is used to connect two or more power cables, control lines, and/or data transmission lines. For example, in an industrial control system having, for example, a power supply device, an automatic power-off device, and a driver of a server motor, usually dozens to hundreds of terminal blocks are required to enable production of frequently changed diverse products, thereby facilitating small-batch production with various specifications by manual labor, automatic production methods, or other suitable methods.

There is a board-to-wire terminal block. One side of the board-to-wire terminal block is coupled to two or more power cables, control lines or data transmission lines, and the other side of the board-to-wire terminal block is coupled to a circuit board. However, inferior connection between the terminal block and the circuit board may occur due to vibrations or other reasons, and sometimes the circuit board also becomes loose or detached from the terminal block, leading to a broken circuit which makes each node inoperative.

Accordingly, in order to improve an anti-pull-out effect between the terminal block and the circuit board and ensure stability and reliability of signal transmission or power delivery, the inventor studied related technology and provided a reasonable and effective solution in the present disclosure.

SUMMARY

It is an objective of the present invention to provide a terminal block fastening device with an enhanced anti-pull-out feature.

It is another objective of the present invention to provide a terminal block fastening device which can automatically fasten a circuit board with a small force and a small displacement.

Accordingly, the present invention provides a terminal fastening device, for fastening a circuit board having at least one fastening hole. The terminal block fastening device includes a body and a locking handle. The body includes a socket for insertion of a printed circuit board, two through holes perpendicular to the socket, and a pillar element disposed between the two through holes. The locking handle is installed in the body. The locking handle includes a force arm, a fastening portion connected to one end of the force arm, a pivot point connected to the other end of the force arm, and a resilient arm disposed between the fastening portion and the force arm. The fastening portion is operatively associated with the resilient arm to be moved between a locked state and a released state.

One advantage of the present invention is that the force point is in the middle of the locking handle. That is to say, one end of the force arm, i.e. the pivot point, is fixed in the pivot hole of the body. The other end of the force arm, i.e. the fastening portion, is driven by the force arm to move to the released state (the released position). Therefore, during operation of the locking handle, less effort is required, and the force arm only needs to move a short distance. Accordingly, the whole structure is small and compact to fit in small equipment.

The resilient arm is disposed between the fastening portion and the pivot point, i.e. above the force arm. In one embodiment, the resilient arm obliquely contacts a bottom of the body, so that the fastening portion of the locking handle stays in the locked state (the locked position) in the socket. When the force arm is moved toward the base by pressing or other method, the fastening portion is moved from the locked state to the released state to be released from the fastening hole of the circuit board. At this point, when the force arm is released, the resilient arm is resiliently restored to drive the fastening portion of the locking handle to return to the locked state (the locked position) from the released state (the released position).

According to one embodiment of the present invention, the fastening portion includes an inclined surface corresponding to the circuit board. When the circuit board is inserted into the socket to contact the fastening portion, the circuit board can smoothly cross the inclined surface, and thereby the fastening portion is moved from the released state to the locked state to fasten the fastening hole of the circuit board. Therefore, by inserting the circuit board, the circuit board can be fastened automatically to enhance an anti-pull-out effect. The circuit board can be detached quickly in a labor-saving manner by pressing the force arm.

BRIEF DESCRIPTION OF THE DRAWINGS

The disclosure will become more fully understood from the detailed description, and the drawings given herein below is for illustration only, and thus does not limit the disclosure, wherein.

DETAILED DESCRIPTION

Figure 1:
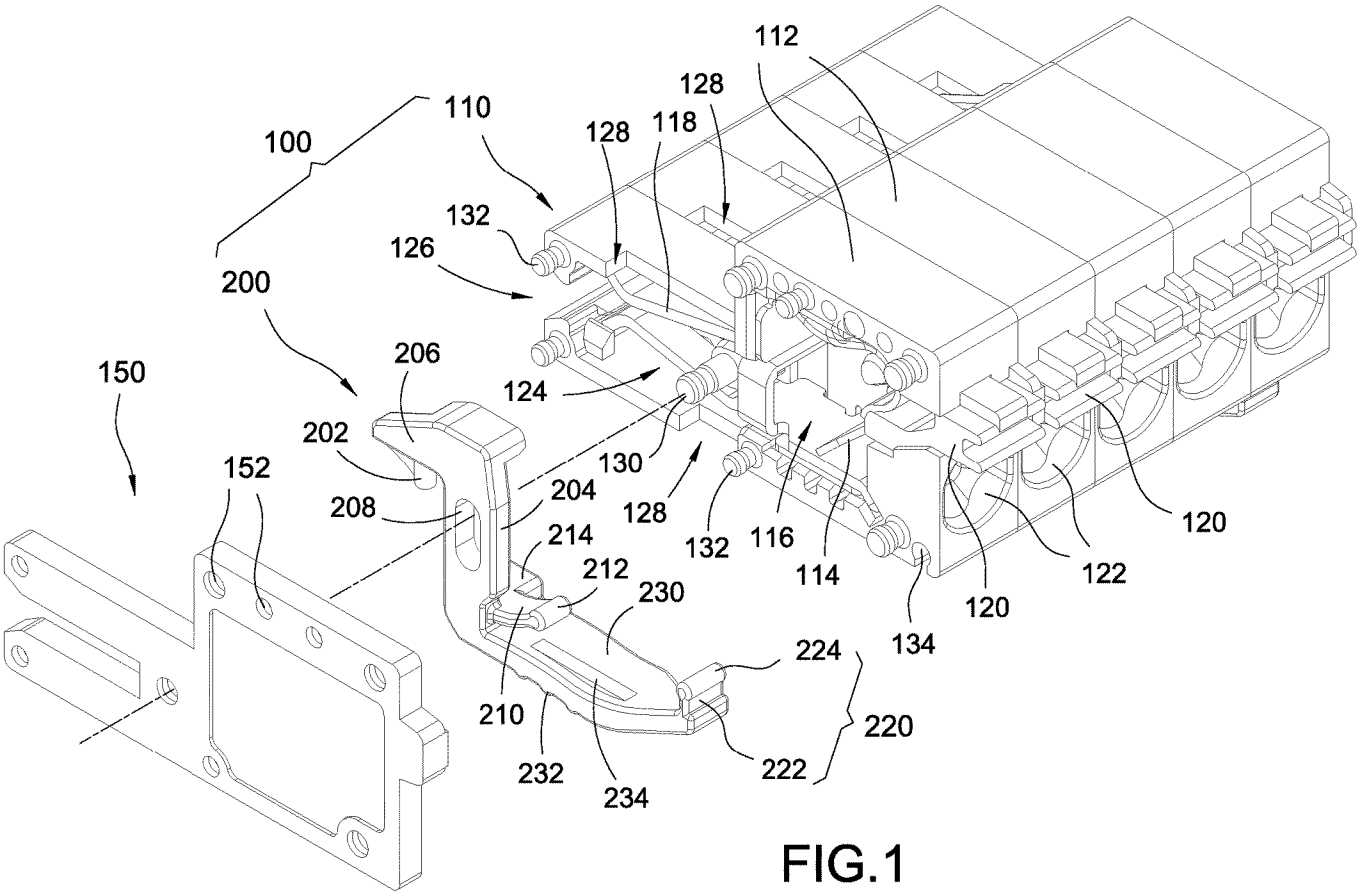
FIG. 1 is an exploded view illustrating a terminal block fastening device according to the present invention.

Detailed descriptions and technical contents of the present invention are illustrated below in conjunction with the accompany drawings. However, it is to be understood that the descriptions and the accompany drawings disclosed herein are merely illustrative and exemplary and not intended to limit the scope of the present invention.

Referring to FIGS. 1 to 5, the present invention provides a terminal block fastening device 100 for fastening a circuit board 10 having at least one fastening hole 20 and a plurality of conductive points 30. The terminal block fastening device 100 includes a body 110 and a locking handle 200. As shown in the drawings, the circuit board 10 can be a printed circuit board (PCB), a flexible printed circuit board (FPC) or other suitable circuit board. The conductive points 30 are preferably disposed on two opposite surfaces of the circuit board 10 so as to be electrically connected to respective corresponding conductive terminals 118 in the body 110 and to transmit signals or power to a cable (not illustrated) at the other side of the body 110. The locking handle 200 is preferably disposed corresponding to the fastening hole 20 of the circuit board 10. It is preferable that there are two locking handles 200 and two fastening holes 20, and the two locking handles 200 and the two fastening holes 20 are disposed correspondingly. However, only one locking handle 200 is described hereinafter for simplicity of description.

Figure 3:
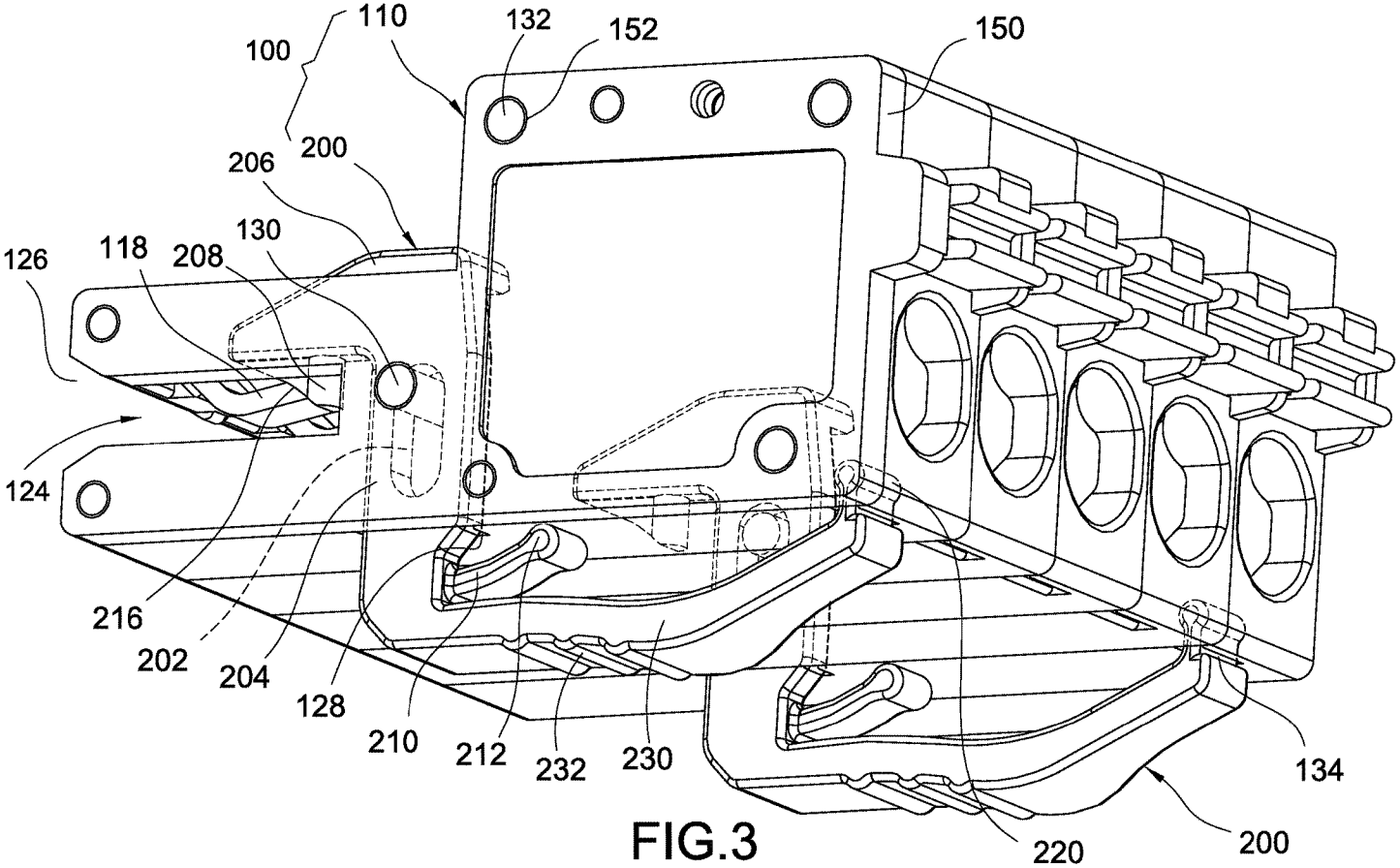
FIG. 3 is a perspective view illustrating the terminal block fastening device.
Figure 4:
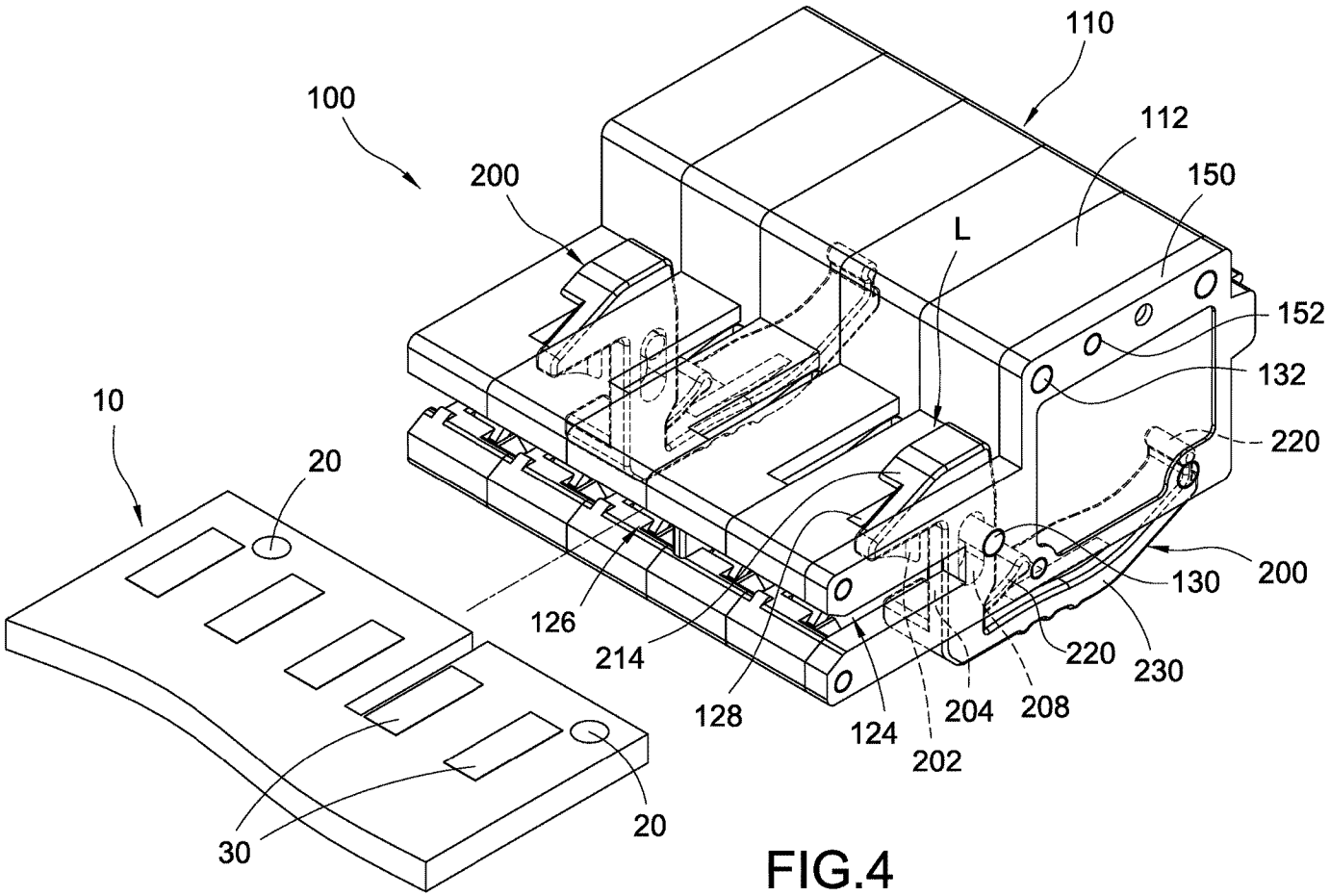
FIG. 4 is a perspective view illustrating the terminal block fastening device coupled to a circuit board.

The body 110 includes a socket 124 for insertion of a printed circuit board 10, two through holes 128 perpendicular to the socket 124, and a pillar element 130 between the two through holes 128. As shown in FIGS. 1, 3 and 4, the body 110 consists of a plurality of bases 112 stacked one above the other, the number of the bases 112 corresponds in number to the number of the cables (not illustrated) to be coupled.

Each of the bases 112 which consist of plastic or other suitable material includes a wiring chamber 116 receiving a disc spring 114, a conductive terminal 118 inserted in the socket 124, and a pressing block 120 movably contacting the disc spring 114. A wiring opening 122 for insertion of the cable (not illustrated) communicates with the wiring chamber 116 and is disposed at one side of the pressing block 120. The disc spring 114 electrically contacts the conductive terminal 118 in the wiring chamber 116. The structure inside the body 110 and operations in relation to the body 110 are conventional techniques, so a detailed description is omitted for brevity.

The locking handle 200 which consists of plastic or other suitable material is installed in the body 110. The locking handle 200 includes a force arm 230, a fastening portion 202 connected to one end of the force arm 230, a pivot point 220 connected to the other end of the force arm 230, and a resilient arm 210 disposed between the fastening portion 202 and the force arm 230, and a guiding hole 208 receiving the pillar element 130. The fastening portion 202 is operatively associated with the resilient arm 210 to be moved between a locked state L and a released state R.

A pivot hole 134 is formed on the body 110 to receive the pivot point 220. The pivot point 220 includes a rod portion 222 connected to the force arm 230 and a top portion 224 connected to the rod portion 222, and the top portion 224 has a larger size than the rod portion 222. The top portion 224 has a round shape cross-section, and the pivot hole 134 is a round hole corresponding to the shape of the top portion 224 so as to fix the pivot point 220 in the pivot hole 134.

Figure 6:
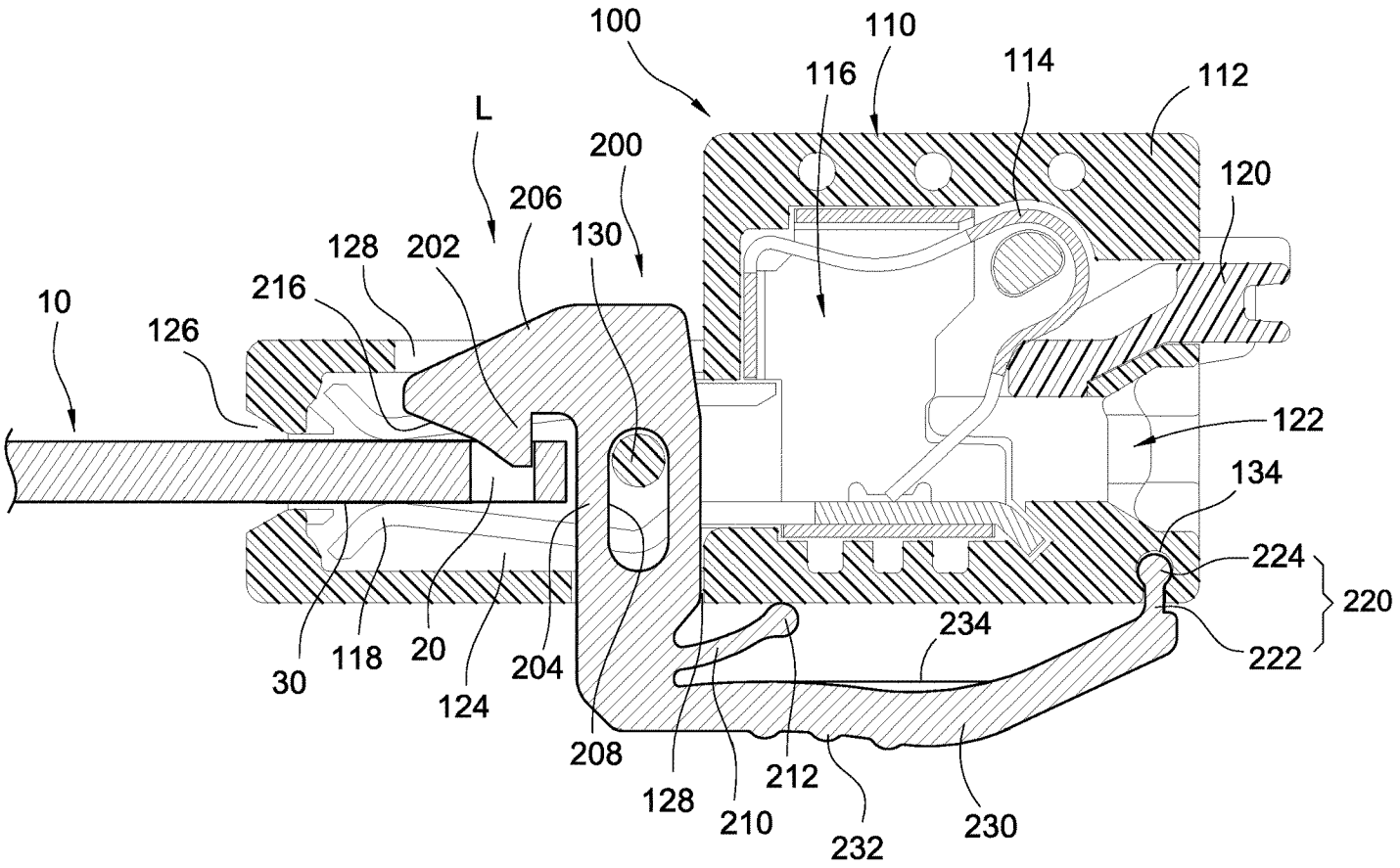
FIG. 6 is a cross-sectional view illustrating a state after the circuit board is inserted into the terminal block fastening device.

When the pillar element 130 is inserted in the guiding hole 208, and the pivot point 220 is assembled to the pivot hole 134, one end of the resilient arm 210 is preferably in contact with a bottom of the body 110. At this point, the fastening portion 202 of the locking handle 200 is in the locked state L, as shown in FIG. 6. In the embodiment shown in FIGS. 1, 3 and 4, the terminal block fastening device 100 further includes a plate 150 for covering and positioning the locking handle 200. A plurality of assembly pillars 132 are disposed on a side surface of the body 110 and are arranged parallel to the pillar element 130, and the plate 150 includes a plurality of assembly holes 152 corresponding to the assembly pillars 132, so that the plate 150 can fix the locking handle 200 in the body 110. Furthermore, a plurality of assembly pillars 132 protrude from one side of the bases 112 while a plurality of assembly holes 152 are formed on the opposite side of bases 112, so that the bases 112 can be stacked one above the other to constitute the body 110 of a required length.

To be specific, the resilient arm 230 is disposed between the fastening portion 202 and the pivot point 220, i.e. above the force arm 230. In the embodiment shown in FIG. 4, the resilient arm 230 obliquely contacts the bottom of the body 110, so that the fastening portion 202 of the locking handle 200 stays in the locked state L in the socket 124. When the force arm 230 is moved toward the base 110 by pressing or other method, the fastening portion 202 is moved from the locked state L to the released state R to be released from the fastening hole 20 of the circuit board 10. At this point, when the force arm 230 is released, the resilient arm 230 is resiliently restored to drive the fastening portion 202 of the locking handle 200 to return to the locked state (a locked position) L from the released state (a released position) R.

Figure 2:
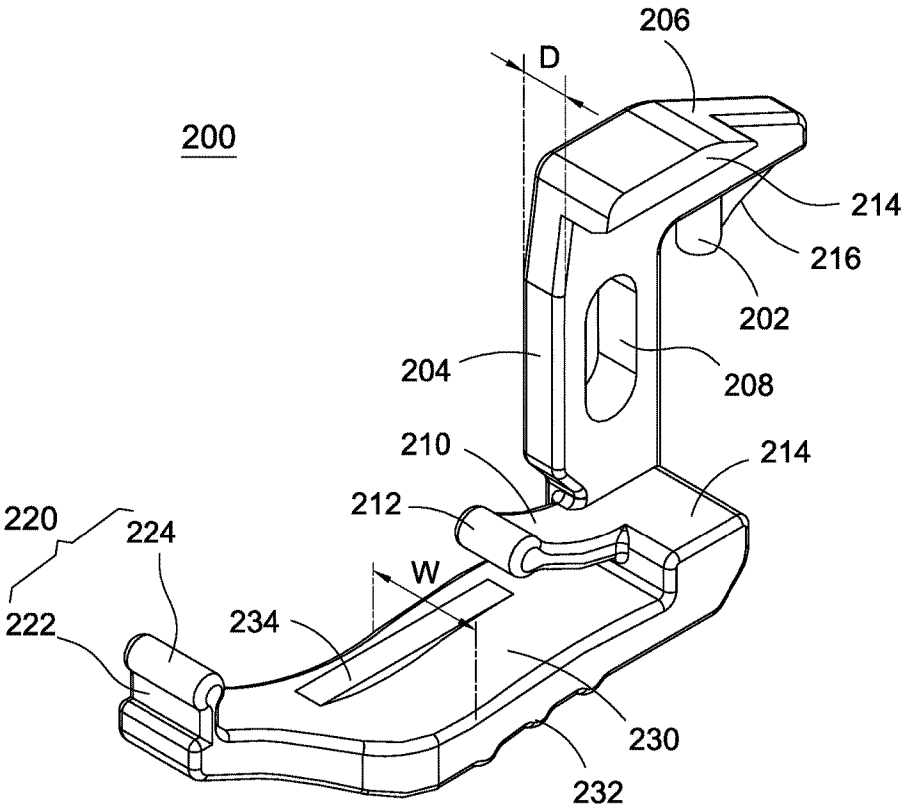
FIG. 2 is a perspective view illustrating a locking handle of the terminal block fastening device.

As shown in FIGS. 1 and 2, the locking handle 200 further includes a neck 204 for connecting the fastening portion 202 and the force arm 230. The neck 204 preferably is vertically connected to the force arm 230. A head 206 extends from one end of the neck 204 toward an opening (i.e. an insertion opening 126) of the socket 124. The fastening portion 202 is disposed below the head 206, the fastening portion 202 includes an inclined surface 216 corresponding to the insertion opening 126 of the socket 124, so that the circuit board 10 can smoothly cross the inclined surface 216, and the fastening portion 202 is moved from the released state R to the locked state L to fasten the fastening hole 20 of the circuit board 10, as shown in FIG. 6.

One end of the resilient arm 210 is connected to the neck 204, and the other end of the resilient arm 210 is a free end 212. The free end 212 is inclined away from the force arm 230. In other words, when the locking handle 200 is assembled to the body 110, the free end 212 of the resilient arm 210 is kept in contact with the bottom of the body 110 and is arranged upwards (the locked state L). The guiding hole 208 is formed in the neck 204, the guiding hole 208 is for insertion of the pillar element 130, so that the neck 204 is movable in relation to the pillar element 130 along the guiding hole 208, and thereby the fastening portion 202 can move in the socket 124 stably and reliably.

Two platforms 214 extend from the neck 204 and the force arm 230 at the same side respectively. The platforms 214 are disposed corresponding the through holes 128 respectively to contact the body 110 and are restricted by the body 110. A thickness (D) of the neck 204 is less than a width (W) of the force arm 230. Furthermore, the through hole 128 near the head 206 has a diameter larger than that of the through hole 128 near the neck 204. In other words, the through hole 128 on the bottom of the body 110 has the same size as the neck 204, so that the fastening portion 202 can move stably and reliably in the socket 124.

Referring to FIG. 6, a length (L) of the force arm 230 is greater than a length (L') of the resilient arm 210, and the force arm 230 has a slight arc shape to be spaced at a distance (not labelled) from the bottom of the body 110. A plurality of protruding patterns 232 are formed on one side of the force arm 230 so that a user can exert force easily. A rib portion 234 is formed on the other side of the force arm 230 to reinforce the strength of the force arm 230.

Figure 5:
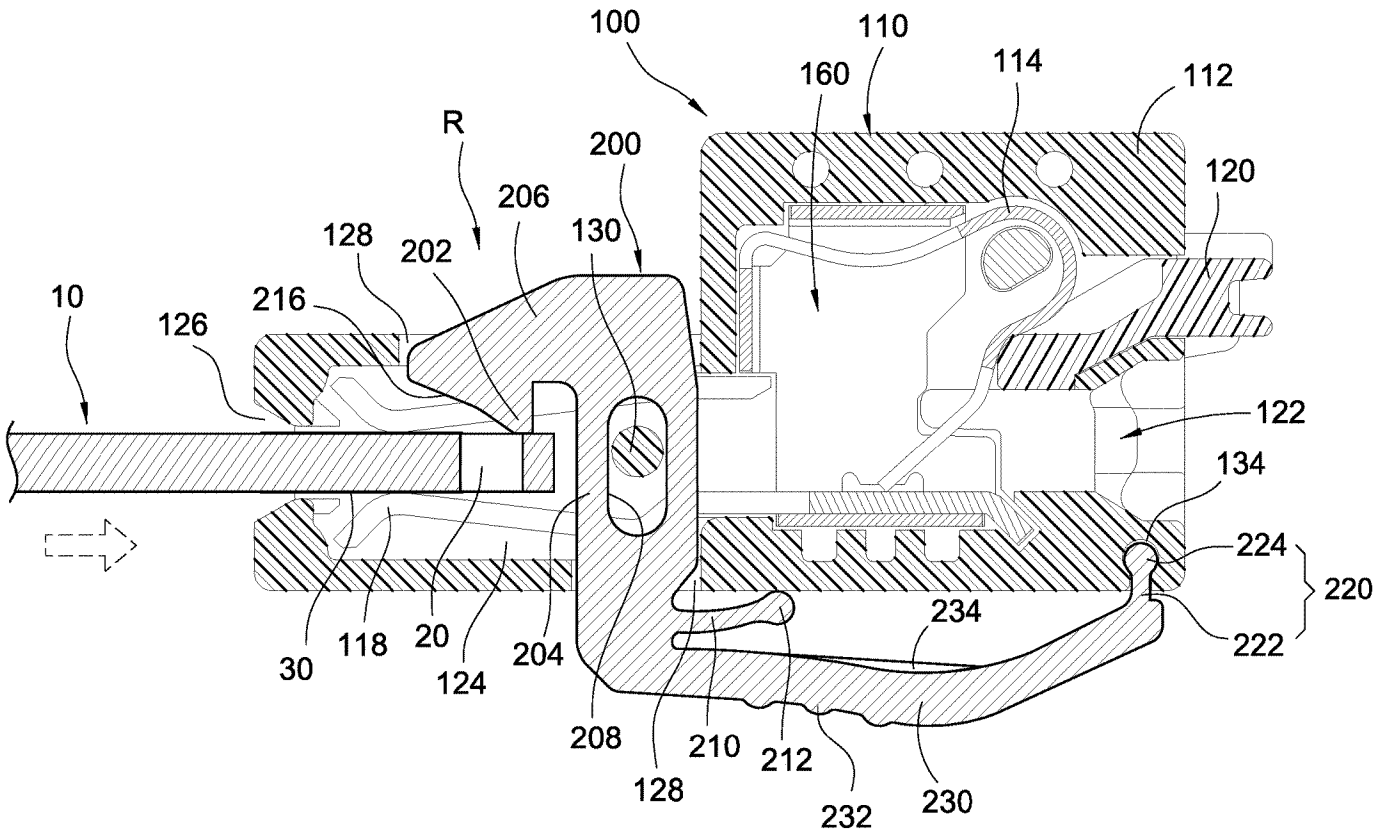
FIG. 5 is a cross-sectional view illustrating a state before the circuit board is inserted into the terminal block fastening device.

Operations of the terminal block fastening device 100 are described further hereinafter in conjunction with FIGS. 5 to 8. As shown in FIGS. 5 and 6, when the circuit board 10 is inserted into the socket 124 from the insertion opening 126 to contact the fastening portion 202, the circuit board 10 smoothly crosses the inclined surface 216, and thereby the fastening portion 202 is moved from the released state R to the locked state L to fasten the fastening hole 20. At this point, the conductive terminal 118 of the body 110 can be electrically connected to the conductive point 30 of the circuit board 10. In the present embodiment, the circuit board 10 is automatically fastened by inserting the circuit board 10, so an anti-pull-out feature of the terminal block fastening device 100 is improved.

Figure 7:
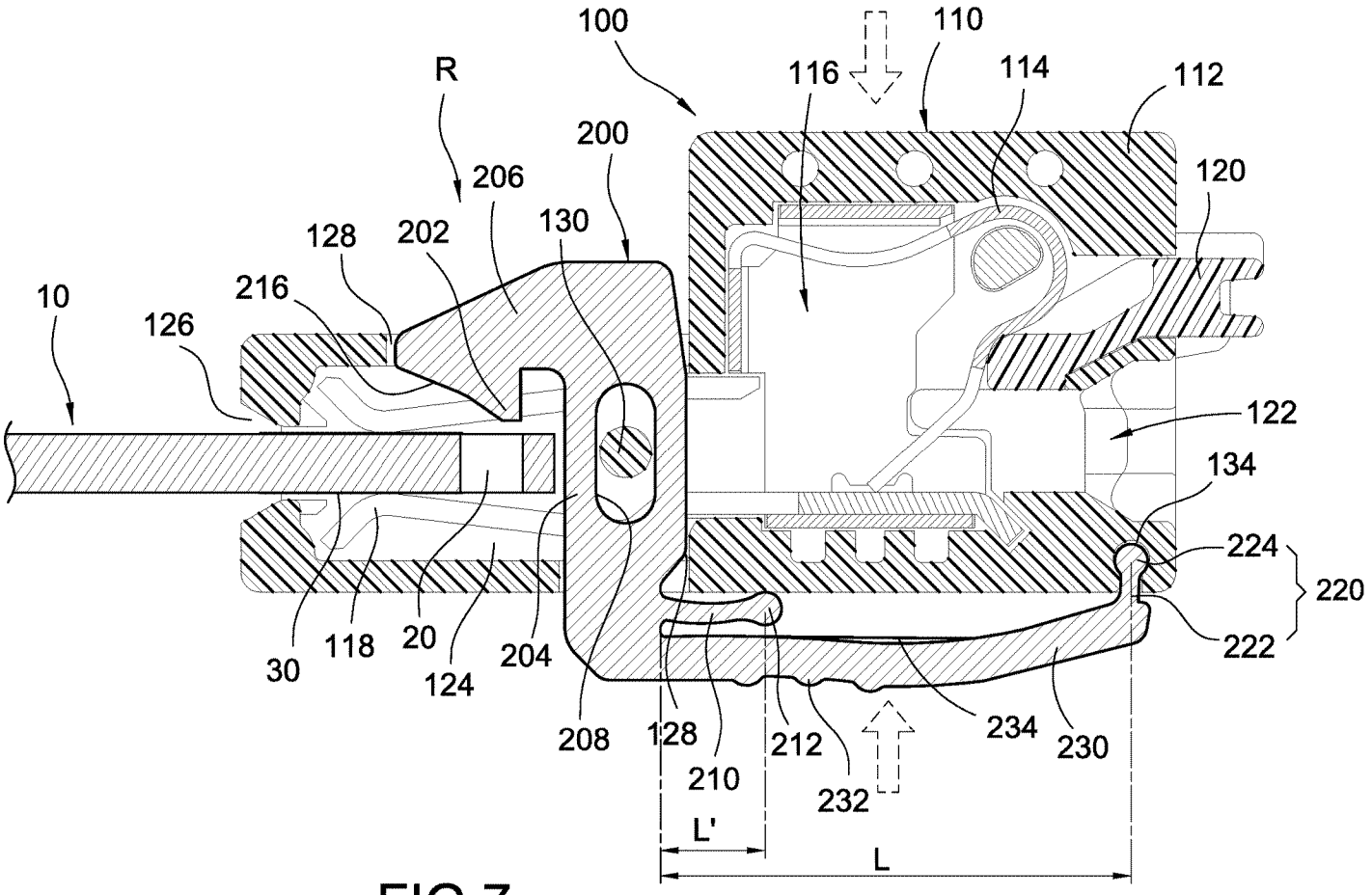
FIG. 7 is a cross-sectional view illustrating that the circuit board is to be detached from the terminal block fastening device.
Figure 8:
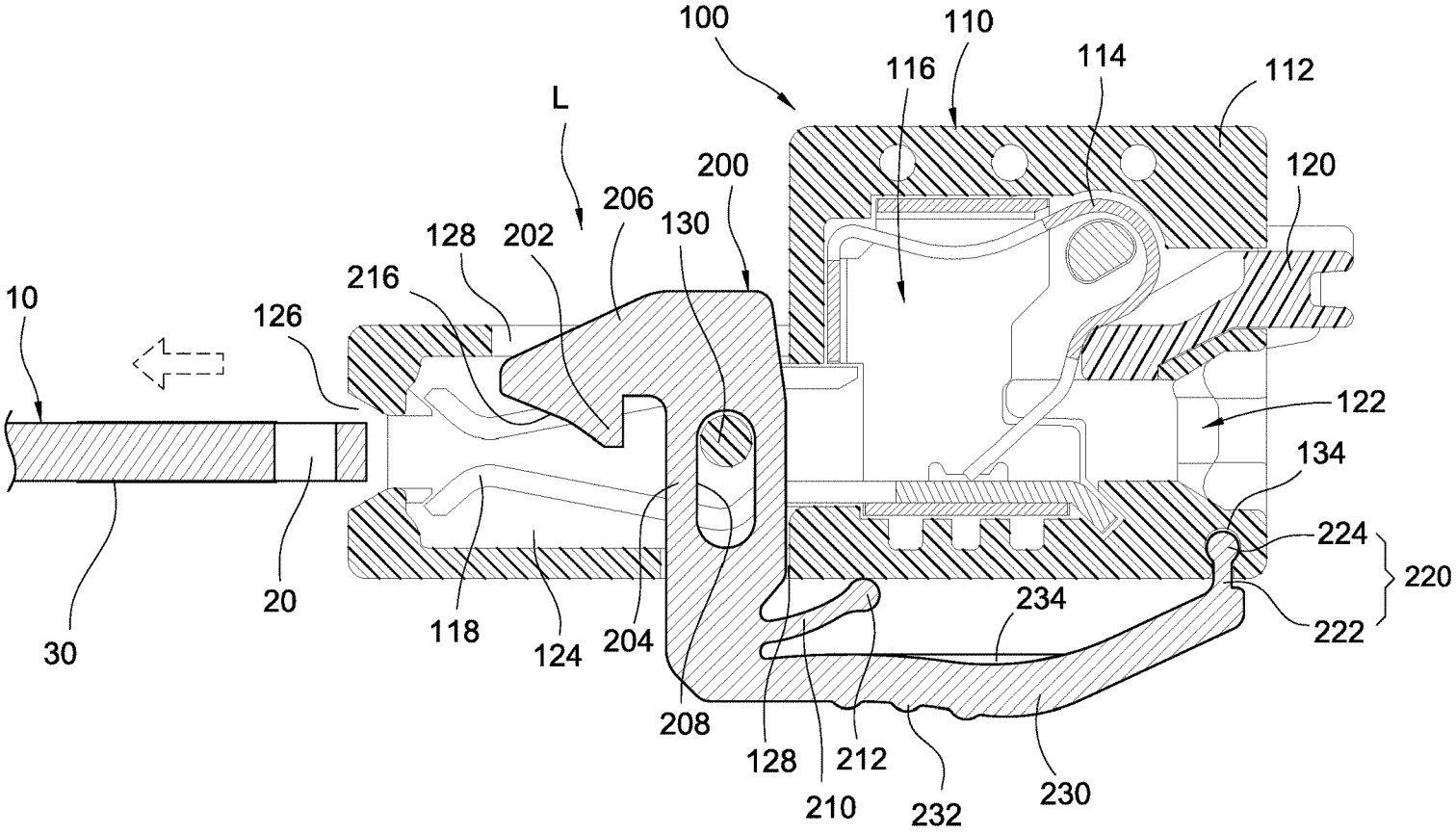
FIG. 8 is a cross-sectional view illustrating that the circuit board is detached from the terminal block fastening device.

As shown in FIGS. 7 and 8, when an operator presses the force arm 230 to move it toward the body 110, the force arm 230 and the neck 204 drive the fastening portion 202 to move in the socket 124 from the locked state L to the released state R until the fastening portion 202 is released from the fastening hole 20. At this point, the oblique resilient arm 210 is forced to become parallel to the force arm 230. After the operator releases the force arm 230, the resilient arm 210 is resiliently restored to the locked state R from the released state L. Therefore, by using the terminal block fastening device 100 of the present invention, the circuit board 10 can be installed or detached easily and quickly, and the force arm 230 only needs to move a short distance.

A force point is in the middle of the locking handle 200. In detail, one end of the force arm 230, the pivot point 220, is fixed in the pivot hole 134 of the body 110. The other end of the force arm 230, i.e. the fastening portion 202, is driven by the force arm 230 to be moved to the locked state L or the released state R. Therefore, during operation of the locking handle 110, less effort is required, and the force arm 230 only needs to move a short distance. Accordingly, the whole structure is small and compact to fit in small equipment or systems.

It is to be understood that the above descriptions are merely the preferable embodiments of the present invention and are not intended to limit the scope of the present invention. Equivalent changes and modifications made in the spirit of the present invention are regarded as falling within the scope of the present invention.

What is claimed is:

1. A terminal block fastening device, for fastening a circuit board (10) having at least one fastening hole (20), the terminal block fastening device (100) comprising:

a body (110) including a socket (124) for insertion of the printed circuit board (10) and two through holes (128) perpendicular to an insertion direction of the printed circuit board (10); and a locking handle (200) installed in the body (110), the locking handle (200) including a force arm (230), a fastening portion (202) connected to one end of the force arm (230), a pivot point element (220) connected to the other end of the force arm (230), and a resilient arm (210) disposed between the fastening portion (202) and the force arm (230), wherein the fastening portion (202) is operatively associated with the resilient arm (210) to be moved between a locked state (L) and a released state (R).

2. The terminal block fastening device according to claim 1, wherein when the circuit board (10) is inserted into the socket (124) to contact the fastening portion (202), the fastening portion (202) is moved from the released state (R) to the locked state (L) to fasten the fastening hole (20) of the circuit board (10); and when the force arm (230) is moved toward the body (110), the fastening portion (202) is moved from the locked state (L) to the released state (R).

3. The terminal block fastening device according to claim 1, wherein the locking handle (200) further includes a neck (204) connected between the fastening portion (202) and the force arm (230), a guiding hole (208) formed on the neck (204), and a head (206) extending from one end of the neck (204) toward an opening of the socket (124).

4. The terminal block fastening device according to claim 3, wherein the fastening portion (202) is disposed below the head (206), and the fastening portion (202) includes an inclined surface (216) corresponding to the insertion direction of the printed circuit board (10).

5. The terminal block fastening device according to claim 3, wherein one end of the resilient arm (210) is connected to the neck (204), the other end of the resilient arm (210) is a free end (212), and the free end (212) is inclined and contacted against a bottom of the body (110).

6. The terminal block fastening device according to claim 3, wherein the body (110) further includes a pillar element (130) disposed between the two through holes (128), and the guiding hole (208) is for insertion of the pillar element (130), so that the neck (204) is movable in relation to the pillar element (130) along the guiding hole (208).

7. The terminal block fastening device according to claim 3, wherein two platforms (214) extend from two ends of the neck (204) respectively, and the platforms (214) are disposed corresponding the through holes (128) respectively to contact the body (110) and are restricted by the body (110).

8. The terminal block fastening device according to claim 3, wherein a thickness of the neck (204) is less than a width of the force arm (230).

9. The terminal block fastening device according to claim 1, wherein a length of the force arm (230) is greater than a length of the resilient arm (210), the force arm (230) has a slight arc shape, a plurality of protruding patterns (232) are formed on one side of the force arm (230), and a rib portion (234) is formed on the other side of the force arm (230).

10. The terminal block fastening device according to claim 1, wherein a pivot hole (134) is formed on the body (110) to receive the pivot point element (220).

11. The terminal block fastening device according to claim 10, wherein the pivot point element (220) includes a rod portion (222) connected to the force arm (230) and a top portion (224) connected to the rod portion (222), and the top portion (224) has a larger size than the rod portion (222).

12. The terminal block fastening device according to claim 11, wherein the top portion (224) has a round shape cross-section, and the pivot hole (134) is a round hole corresponding to the shape of the top portion (224).

13. The terminal block fastening device according to claim 1, further comprising a plate (150) for covering and positioning the locking handle (200).

14. The terminal block fastening device according to claim 13, wherein a plurality of assembly pillars (132) are disposed on a side surface of the body (110) and are arranged parallel to a pillar element (130) disposed between the two through holes (128), and the plate (150) includes a plurality of assembly holes (152) corresponding to the assembly pillars (132).

15. The terminal block fastening device according to claim 1, wherein the body (110) consists of a plurality of bases (112) stacked side by side, each of the bases (112) includes a wiring chamber (116) receiving a disc spring (114), a conductive terminal (118) inserted in the socket (124), and a pressing block (120) movably contacting the disc spring (114).

* * * * *